US007597075B2

(12) United States Patent
Schafer et al.

(10) Patent No.: US 7,597,075 B2
(45) **Date of Patent: *Oct. 6, 2009**

(54) ELECTRICALLY DRIVEN CAMSHAFT ADJUSTER

(75) Inventors: Jens Schafer, Herzogenaurach (DE); Mike Kohrs, Wilthen (DE); Martin Steigerwald, Erlangen (DE); Jonathan Heywood, Pettstadt (DE)

(73) Assignee: Schaeffler KG, Herzogenaurach (DE)

( * ) Notice: Subject to any disclaimer, the term of this patent is extended or adjusted under 35 U.S.C. 154(b) by 353 days.

This patent is subject to a terminal disclaimer.

(21) Appl. No.: 11/571,861

(22) PCT Filed: Jun. 15, 2005

(86) PCT No.: PCT/EP2005/006387

§ 371 (c)(1),
(2), (4) Date: Jan. 9, 2007

(87) PCT Pub. No.: WO2006/005406

PCT Pub. Date: Jan. 19, 2006

(65) Prior Publication Data

US 2008/0053389 A1 Mar. 6, 2008

(30) Foreign Application Priority Data

Jul. 10, 2004 (DE) ..... 10 2004 033 522

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.11, 90.16, 90.18; 464/1, 2, 464/160

See application file for complete search history.

(56) References Cited

U.S. PATENT DOCUMENTS

| | | | | |
|---|---|---|---|---|
| 5,680,837 | A | 10/1997 | Pierik | |
| 6,328,006 | B1 * | 12/2001 | Heer | 123/90.15 |
| 6,758,788 | B2 * | 7/2004 | Itou | 477/8 |
| 6,981,478 | B2 * | 1/2006 | Schafer et al. | 123/90.17 |
| 7,032,552 | B2 * | 4/2006 | Schafer et al. | 123/90.17 |
| 2002/0100446 | A1 | 8/2002 | Watanabe | |
| 2004/0184205 | A1 | 9/2004 | Ido et al. | |

FOREIGN PATENT DOCUMENTS

| | | |
|---|---|---|
| AT | 409786 | 11/2002 |
| DE | 19541770.4 | 6/1997 |
| DE | 10207760 | 9/2003 |
| DE | 10248355 | 4/2004 |
| DE | 10326886 | 12/2004 |
| DE | 10332264 | 2/2005 |
| EP | 1128027 | 8/2001 |
| WO | 2004007917 | 1/2004 |
| WO | 2005047659 | 5/2005 |

* cited by examiner

*Primary Examiner*—Ching Chang
(74) *Attorney, Agent, or Firm*—Volpe and Koenig, P.C.

(57) ABSTRACT

Adjustment device (1) for adjusting a relative rotational angle position of a camshaft (3) relative to a crankshaft of an internal combustion engine is provided. The adjusting device includes a crankshaft-fixed drive part (4) and a camshaft-fixed driven part (5). The adjustment device (1) has an adjustment motor (2) as a primary adjustment device and an auxiliary drive (11) as a secondary adjustment device. When the adjusting motor fails, the camshaft (3) can be moved into a fixed rotational angle position, an emergency running position, by the auxiliary drive (11).

13 Claims, 6 Drawing Sheets

ELECTRICALLY DRIVEN CAMSHAFT ADJUSTER

BACKGROUND

The invention relates to an adjustment device for adjusting the relative rotational angle position of a camshaft relative to a crankshaft of an internal combustion engine with an adjustment transmission that is constructed as a triple-shaft transmission and that has a crankshaft-fixed drive part, a camshaft-fixed driven part, and an adjustment shaft connected to an adjustment motor shaft of an adjustment motor.

To guarantee a reliable start of an internal combustion engine with a hydraulic or electric camshaft adjustment system, the camshaft must be located in the so-called base or emergency running position. For intake camshafts, this position typically lies in a "retarded" position; for exhaust camshafts, it lies in an "advanced" position. In normal operation of the vehicle, the camshaft is moved into the respective base position and fixed or locked there when the engine is turned off.

Conventional, hydraulically activated rotary piston adjusters, such as vane cells, pivoting or segmented blades, have a locking unit. This unit fixes the hydraulic adjuster in its base position until sufficient oil pressure has built up for adjusting the camshaft. If the engine stalls, the camshaft can be located in an undefined position outside of the base position.

For hydraulic camshaft adjustment systems with a "retarded" base position, the camshaft is automatically moved into the retarded base position at the next start of the internal combustion engine and when there is insufficient oil pressure due to the camshaft moment of friction, which acts against the camshaft direction of rotation. If the system has an "advanced" base position, the camshaft must be moved into the advanced base position when there is insufficient oil pressure against the camshaft moment of friction. This happens mostly with the help of a compensation spring, which generates a moment directed against the camshaft moment of friction.

These methods, which are typical for hydraulic camshaft adjusters, for moving into the base position after the internal combustion engine stalls cannot be used in electrically driven camshaft adjusters. They are also unnecessary as long as the adjustment motor system is intact and the camshaft can be moved into the respective base position also for vertical internal combustion engines or for a new start. For electrical adjustment motor systems, however, the adjustment motor and/or its controller can be eliminated and therefore reaching the base position can fail.

In DE 41 10 195 A1, a device for adjusting the rotational angle position between a camshaft and a crankshaft of an internal combustion engine is described, with an adjustment mechanism, which is constructed as a triple-shaft transmission and which has a drive shaft connected to the crankshaft, a driven shaft connected to the camshaft, and an adjustment shaft connected to an electric adjustment motor, wherein for a stationary adjustment shaft there is a stationary transmission ratio $I_0$, which defines the type of transmission (minus or plus transmission) and the adjustment direction of the camshaft to the base or emergency running position.

Each adjustment device has the goal of smooth running and precise setting of the camshaft position. So that the function of the internal combustion engine can be maintained at least temporarily if the adjustment motor system becomes disabled, the adjustment angle is limited. In such a case, however, there is no indication on reaching the base or emergency running position. In addition, for each construction, the base position must be located in one of the two end positions of the camshaft adjuster; the camshaft adjuster always runs towards advanced or retarded contact.

Under certain thermodynamic viewpoints, however, it is desirable to select an arbitrary middle position as the base position.

SUMMARY

Therefore, the invention is based on the objective of creating an adjustment device for adjusting the rotational angle position of a camshaft relative to a crankshaft of an internal combustion engine, which can be moved into any, especially middle emergency running position if the adjustment motor is turned off.

According to the invention, the objective is met for an internal combustion engine with the features of the preamble of claim 1, such that the adjustment device has an adjustment motor as a primary adjustment device and an auxiliary drive as a secondary adjustment device, wherein the auxiliary drive moves the camshaft into a fixed rotational angle position, an emergency running position, if the adjustment motor is turned off.

The auxiliary drive can have an active or passive construction. For an active auxiliary drive, a controller, a switch, and an actuator are necessary. It is activated only when necessary and thus consumes energy only during these times. Then the actual position relative to the emergency running position is detected, a targeted supply of energy is derived from the actual position, and then the emergency running position is attained. It is advantageous when the activation is performed by the appropriate operating medium of the auxiliary drive. The auxiliary motor can be, for example, a pneumatic motor, which in the normal state is decoupled from the adjustment shaft by a spring. In this case, if the adjustment motor is turned off, then activation is performed through compressed air.

A passive auxiliary drive is permanently coupled with the main drive. The base position of the camshaft corresponds to the neutral position of the triple-shaft transmission system with the auxiliary drive. In normal operation, energy is supplied to the auxiliary drive with each rotational angle adjustment out of the base position. Then, if the main drive operating against the auxiliary drive fails, the auxiliary drive moves the rotational angle position of the camshaft into the base position. For a passive auxiliary drive, only one actuator is required. A controller and switch can be eliminated.

Active auxiliary drives are advantageous in that no energy is consumed in the auxiliary drive during normal operation and thus there are no reaction effects, usually in the form of oscillations. An advantage of the passive auxiliary drive is its simpler and more economical realization. Both auxiliary drives can also be connected to form a hybrid drive, so that, in one direction a passive adjustment is performed, which can be realized, for example, through friction, and in the opposite direction the adjustment can be performed by turning on an active system, which then acts in only one direction.

The auxiliary drive can work basically in two ways. First, it can act on the adjustment shaft and the torque is converted on the sprocket wheel or the camshaft. Then a small moment of the auxiliary drive is required, but it should deliver a high rotational speed. For example, for a typical, maximum camshaft adjustment of 30° at a ratio of the adjustment mechanism of 1:60, five rotations of the adjustment shaft are necessary.

Second, the auxiliary drive can act directly on the sprocket wheel or the camshaft; the torque is then converted one under the other. In this case, a high moment is required. Friction effects or bearing damage then have a greater influence on the adjustment moment between the camshaft and sprocket wheel.

In more detail, the auxiliary drive can be realized, for example, by a torsion spring, a hydraulic motor, a pneumatic motor, an electric auxiliary motor, a brake, a centrifugal force motor, a triple-shaft transmission, a switchable free-running wheel, a flywheel, or by the use of the mass moment of inertia of the adjustment motor itself.

If the auxiliary drive is constructed as a torsion spring, this is arranged either between the adjustment shaft and sprocket wheel or between the sprocket wheel and camshaft. It can have a double-acting construction or it can be constructed as a torsion spring with gear reduction. This system requires low technical expense; its switching time is as designed.

If the auxiliary drive is constructed as a hydraulic motor, it can generate a high moment. Its switching time is dependent on the viscosity of the work medium necessary for the operation, for example, oil. This disadvantage is balanced by its low reaction effect both in the case of failure and also in normal operation, because it can then run without oil. It also requires energy only in the case of failure. If the auxiliary drive is constructed as a pneumatic motor, the switching time does not depend on the viscosity. However, one must take into account a lower efficiency relative to a hydraulic motor in the case of an electric motor failure.

An auxiliary drive constructed as an electric actuator has a short switching time and consumes little energy when needed. This drive can be, for example, an emergency running winding or a coupled electric motor, but also a battery or a capacitor. If the auxiliary drive is constructed as a brake, for example, in combination with the triple-shaft transmission or as a brake lining or as an eddy current brake, it features the same advantages of the electric auxiliary motor for an even smaller reaction effect on the normal operation.

An auxiliary drive is also easy to realize in the form of an adjustment shaft with a flywheel. This system exerts a small reaction effect in the case of failure. Therefore, this reaction effect on the normal operation can be detected due to the higher inertia.

The auxiliary drive can also be constructed as a centrifugal force motor. Then a passive or active system can be realized, whose switching times depend on the design and the camshaft rotational speed. There are almost no reaction effects in the case of failure. Therefore, the reaction effect increases in the normal operation with the rotational speed of the camshaft. This mechanism is ready to use as soon as the drive wheel experiences a certain minimum rotational speed.

The arrangement of the auxiliary drive according to claim 2 between the drive part and the driven part can be considered spatially but is not limited to this view. Instead, the arrangement relates to a flow of forces, which result from the especially advantageous constructions also described above in more detail. For example, if the adjustment motor is constructed as an electric motor, then it is arranged axially in front of the camshaft in the state of the art. An auxiliary drive constructed as a brake winding in the electric motor is then also arranged axially in front of the camshaft and acts on the drive part and driven part via a triple-shaft transmission.

In conclusion, passive systems win out due to their simplicity in construction, but they have a disadvantageous effect on the normal operation due to the continuous power consumption and discharge under deflection. An active system avoids these disadvantages but is more complex in construction.

In the case of failure, if the auxiliary drive is used, the emergency running position can be held by three different measures: either by an active control; by a positive fit, which can be realized, for example, by means of an locking peg that acts in the axial or radial direction and that is activated with oil pressure or air pressure or also electromagnetically, or by a non-positive fit, for example, by a switchable free-running wheel.

For protecting the adjustment shaft and/or the adjustment mechanism from overloading due to sudden blocking of the adjustment shaft of the electric adjustment motor, an overload coupling can be arranged between this and the camshaft. This overload coupling can be constructed, for example, as a sliding clutch or shearing pin.

Through the solution according to the invention, the safety from failure of the adjustment device is significantly increased. This construction gives the possibility of operating easily assembled passive systems or using active systems with less reaction effect on the operation.

BRIEF DESCRIPTION OF THE DRAWINGS

The invention is explained in more detail below and illustrated in the associated drawings. Shown are.

DETAILED DESCRIPTION OF THE PREFERRED EMBODIMENTS

Figure 1:
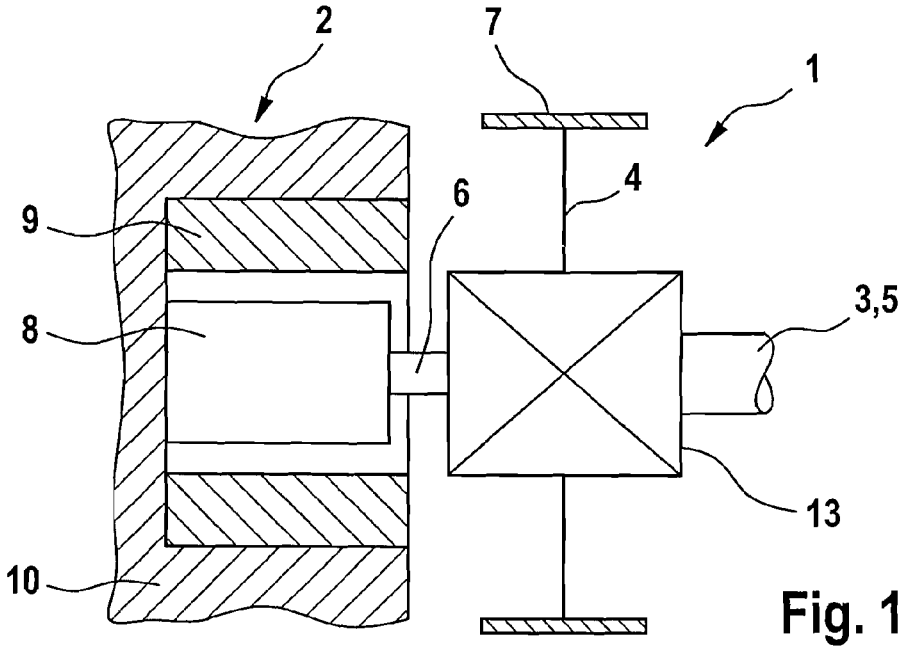
FIG. 1 a schematic view of an adjustment device with an adjustment motor, whose stator is fixed to the cylinder head, FIG. 2 a schematic view of an adjustment device with an adjustment motor constructed as a flywheel, FIG. 3*a* a schematic view of an auxiliary drive, which is constructed as a torsion spring and which is arranged between the sprocket wheel and camshaft, FIG. 3*b* a schematic view of an auxiliary drive, which is constructed as a spring and which acts between the sprocket wheel and the adjustment shaft, FIG. 4 a schematic view of an adjustment device with a pneumatic or hydraulic motor arranged between the adjustment shaft and sprocket wheel, FIG. 5*a* a cross section of an auxiliary drive, which is constructed as a centrifugal force motor and which is located in the base position, FIG. 5*b* a cross section of an auxiliary drive, which is constructed as a centrifugal force motor and which is not located in the base position, FIG. 6*a* a schematic view of an adjustment device with auxiliary drive and a brake arranged internally, FIG. 6*b* a schematic view of an adjustment device with auxiliary drive and a brake arranged externally, FIG. 7*a* a schematic view of an adjustment device with an auxiliary drive powered by capacitors, FIG. 7*b* a schematic view of an adjustment device with an auxiliary drive powered by an external voltage source, FIG. 7*c* a schematic view of an adjustment device with an external auxiliary drive constructed as an electric motor, FIG. 8 a schematic view of an adjustment device with an overload coupling, FIG. 9 a cross section through an adjustment device with a locking unit.

One embodiment of the invention is shown in FIG. 1 as an adjustment device 1 with an adjustment transmission 13 and an adjustment motor 2, which is comprised essentially of a rotor 8 and a stator 9. This is used for adjusting the rotational angle position between the not-shown crankshaft and the camshaft 3 of an internal combustion engine. The adjustment transmission 13 is constructed as a triple-shaft transmission, with a drive part 4, a driven part 5, and an adjustment shaft 6. The drive part 4 is connected rigidly to a drive wheel 7 and to the crankshaft via this drive wheel by a not-shown gear, toothed belt, or a silent chain. The driven part 5 is in fixed connection with the camshaft 3, and the adjustment shaft 6 is in fixed connection with the rotor 8 of the adjustment motor 2. The stator 9 of the adjustment motor 2 is connected rigidly to the cylinder head 10 and is stationary. The camshaft 3 has a base or emergency running position, which must be reached for a reliable start and limited operation. For an intact adjustment motor 2, this is successful, even after the internal combustion engine stalls, without an auxiliary drive 11 (FIG. 2), because the adjustment motor 2 adjusts the camshaft 3 for a stationary internal combustion engine or during the new start in the base position. Without an auxiliary drive 11, however, control of the rotational angle position is not possible for defective adjustment motors 2.

Figure 2:
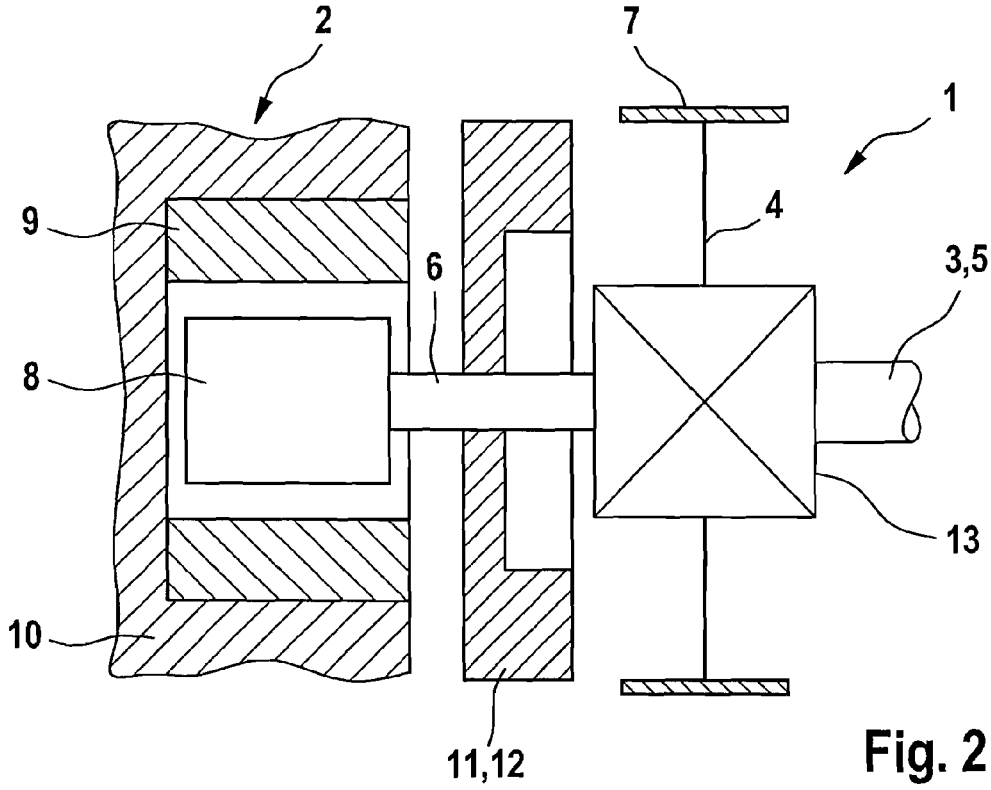

FIG. 2 shows an auxiliary drive 11, which is constructed as a flywheel 12 and which is arranged directly on the adjustment shaft 6 and thus is rigidly connected to the adjustment motor 2. Thus, the drive wheel 7 is in active connection, first, with the adjustment shaft 6 and, two, with the camshaft 3. The flywheel 12 can be integrated into the adjustment device 1 in a space-saving way, wherein it is especially advantageous to arrange the masses as far as possible from the rotational axis, in order to be able to use the smallest possible mass for the given moment of inertia. However, if the rotor 8 of the adjustment motor 2 already has a large mass, then an extra flywheel 12 can possibly be eliminated if the rotor 8, which can also act as a torque accumulator, has a sufficiently high torque.

Figure 3A:
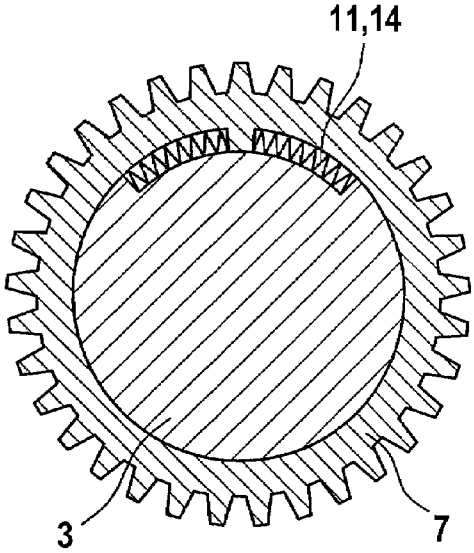
Figure 3B:
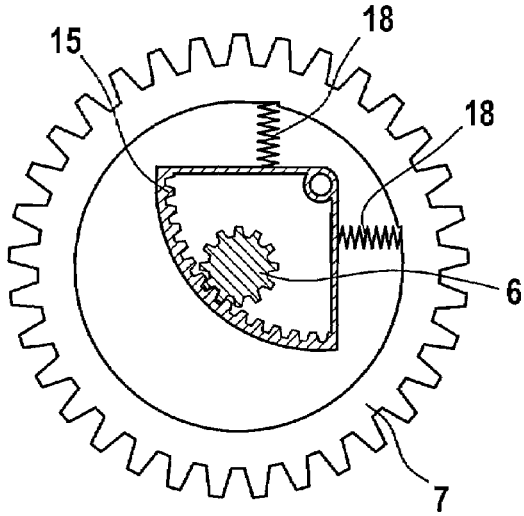

In FIG. 3*a*, an auxiliary drive 11 constructed as a double-acting torsion spring 14 is shown. It acts between the camshaft 3 and the drive wheel 7. The base position is then formed by the rotational angle between the camshaft position and the drive wheel position, in which a balance of moments is produced without the action of the adjustment motor 2. In the normal operation, the electric adjustment motor 2 changes the balance and thus deflects the torsion spring 14. Then if the adjustment motor 2 fails, the torsion spring 14 relaxes from its excursion into its home position. The torsion spring 14 itself can have a single-acting or double-acting construction. In FIG. 3*b*, a spring 18 is arranged between the drive wheel 7 and the adjustment shaft 6. The moment is then transmitted by a gear reduction 15 to the adjustment shaft 6; otherwise the function mechanism corresponds to that of FIG. 3*a*. Here, in particular, a single-acting spring 18 or a spiral spring can also be used.

Figure 4:
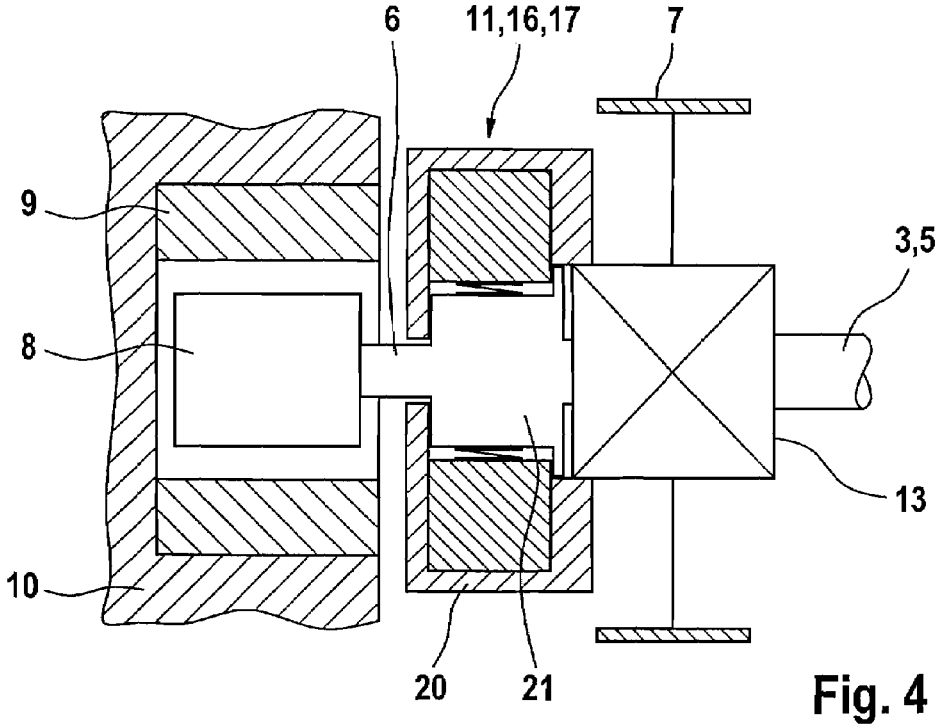
Figure 9:
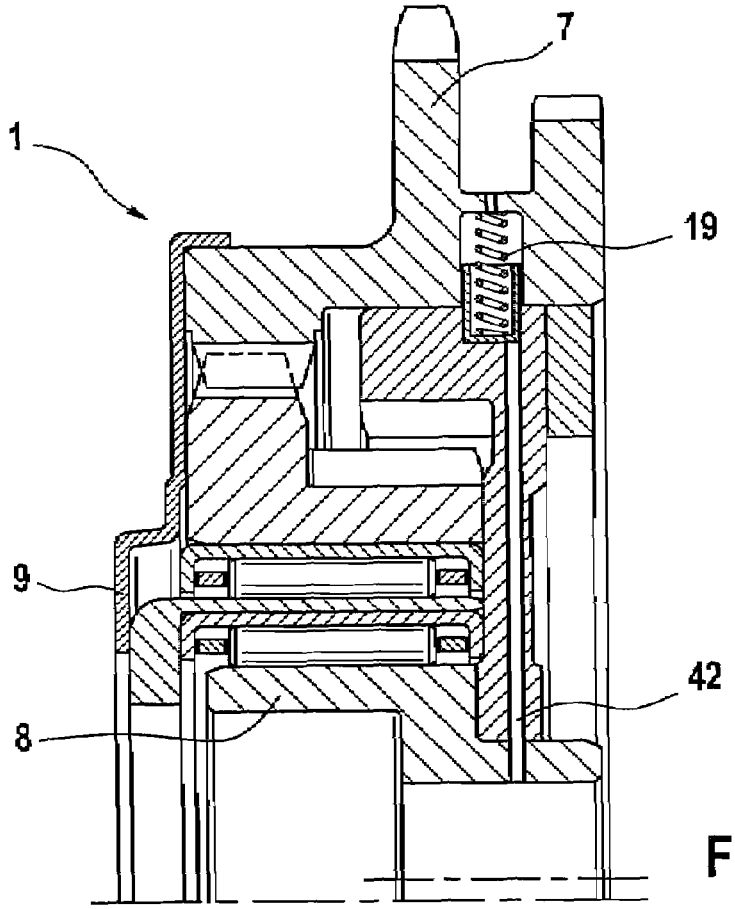

FIG. 4 represents an adjusting device 1 with an auxiliary drive 11, which is constructed as a pneumatic motor 16. The housing 20 of the pneumatic motor is locked in rotation with the drive wheel 7 with its chambers. The pneumatic motor rotor 21 is locked in rotation with the adjustment shaft 6. As soon as the adjustment motor 2 fails, as an active drive the pneumatic motor 16 can either take over its function permanently or else, for the passive auxiliary drives, the adjustment device 1 can be set only in the base position, which then remains fixed by a locking unit 19 (FIG. 9). Possible embodiments of the pneumatic motor 16 would be, for example, a rotating piston air engine or a gear motor.

Instead of as a pneumatic motor 16, the auxiliary drive 11 can also be constructed as a hydraulic motor 17, wherein it is especially preferably to use a roller cell pump, an internal gear pump, or a flow pump.

Figure 5A:
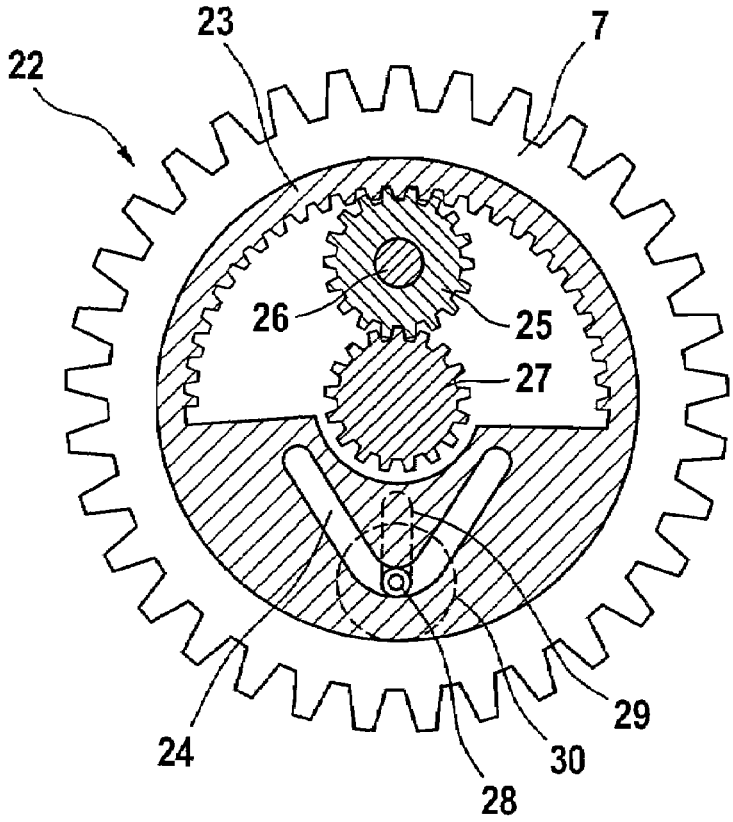
Figure 5B:
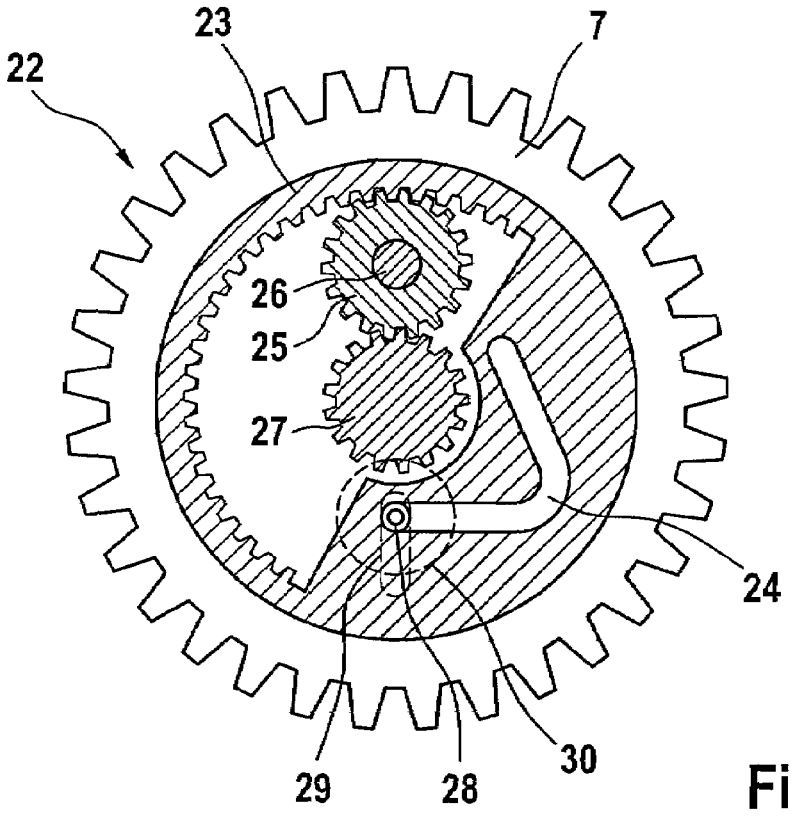

FIGS. 5*a* and 5*b* represent a centrifugal force motor 22, which is comprised essentially of a hollow wheel 23 with a connecting member 24, which is mounted on the drive wheel 7 so that it can rotate relative to this part.

The hollow wheel 23 is in active transmission connection via a planet gear 25, which is arranged on a web shaft 26 connected rigidly to the drive wheel 7, with a sun gear 27 arranged on the adjustment shaft 6. A carrying sleeve 28 with a mass 30, which is simultaneously guided in an elongated hole 29, is guided in the connecting member 24, wherein the elongated hole is integrated into the drive wheel 7 and extends in the radial direction. Instead of a carrying sleeve 28, a sliding block can also be arranged. In principle, the connecting member 24 can have any shape, as long as it does not project precisely in the radial direction, and the base position of the device corresponds to the carrying sleeve position farthest from the center point of the hollow wheel 23 in the radial direction. Especially advantageous is a parabolic or V-shaped construction of the connecting member 24.

The centrifugal force motor 22 is ready to use as soon as the drive wheel 7 has reached a minimum rotational speed. Then, when the adjustment motor 2 initiates a rotational angle adjustment, it rotates the drive wheel 7 via the adjustment shaft 6 and the sun gear 27. Simultaneously, the hollow wheel 23 is turned via the coupling with the planet gears 25, whereby the mass 30 is pulled radially inwards via the connecting member (FIG. 5*b*). If the adjustment motor 2 fails, the mass 30 moves into the position farthest on the outside due to the centrifugal force. The flow of power reverses and the adjustment device 1 is moved into the base position. There the adjustment device 1 can be optionally locked with a locking unit 19 (FIG. 9).

Figure 6A:
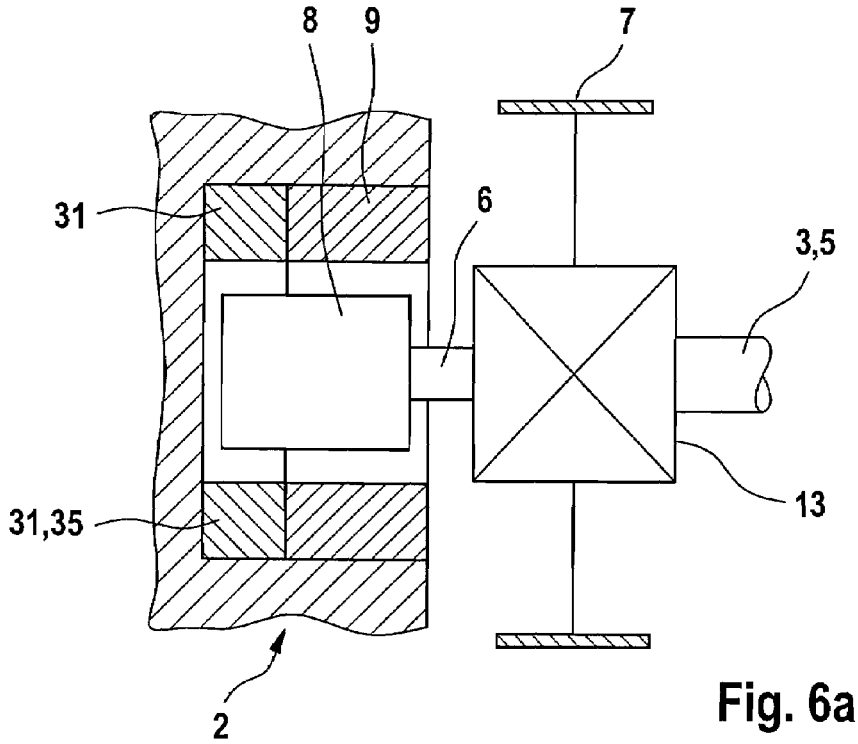
Figure 6B:
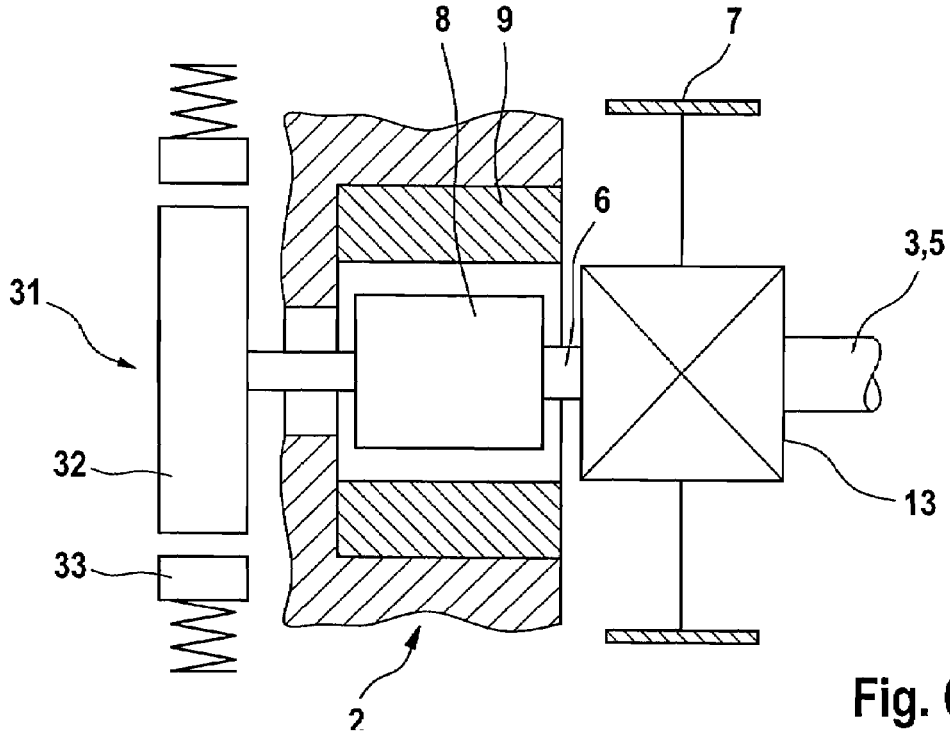

In FIGS. 6*a* and 6*b*, the auxiliary drive 11 is constructed as a brake 31, wherein in FIG. 5*a* it involves a brake 31 integrated into the electric adjustment motor. It can be constructed, for example, as a short-circuit brake winding and thus can brake the adjustment motor 2 via induction. Another possibility would be a separate winding, which can be used as an emergency running winding 35. However, the brake 31 can also be arranged externally (FIG. 6*b*), for example, as a brake disk 32, which is arranged on the adjustment shaft and which is braked in the case of failure via brake blocks 33, which are activated hydraulically or electromagnetically. Other possible embodiments of the brake 31 include band brakes, disk brakes, and shoe brakes. The brake 31 can act directly on the driven part 5 and thus on the camshaft 3 or indirectly, for example, on a shaft, which is connected via a coupling to the adjustment shaft.

Figure 7A:
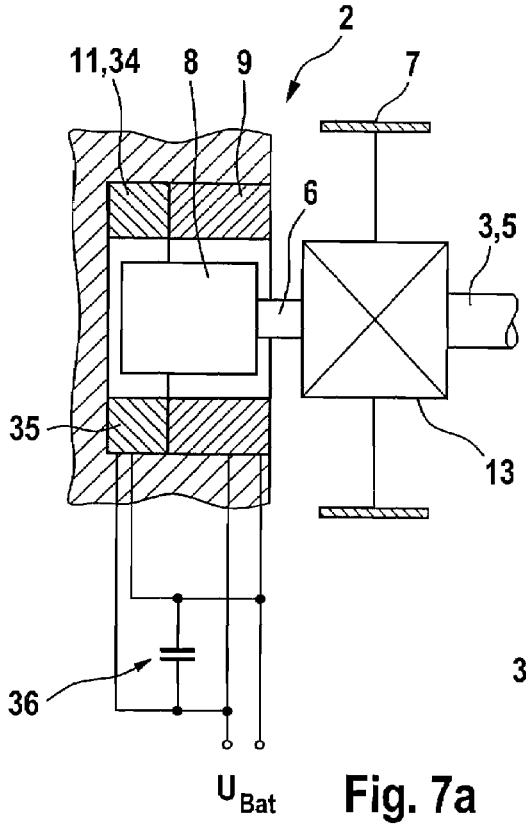
Figure 7B:
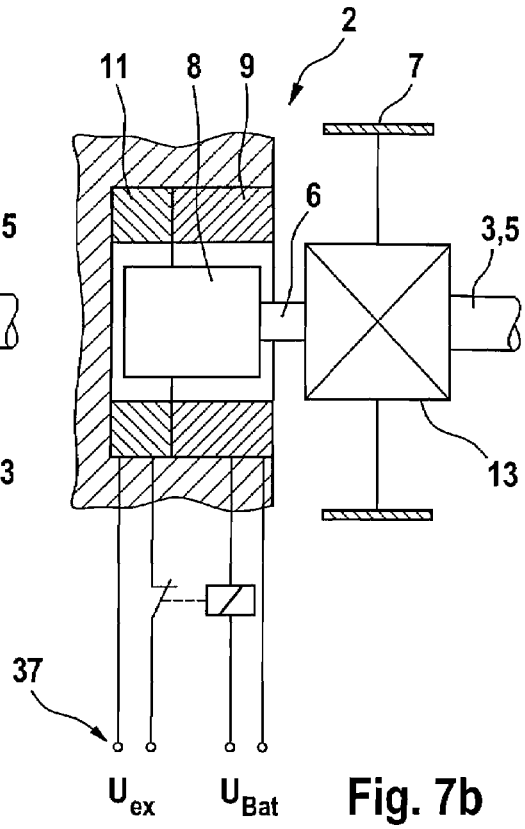
Figure 7C:
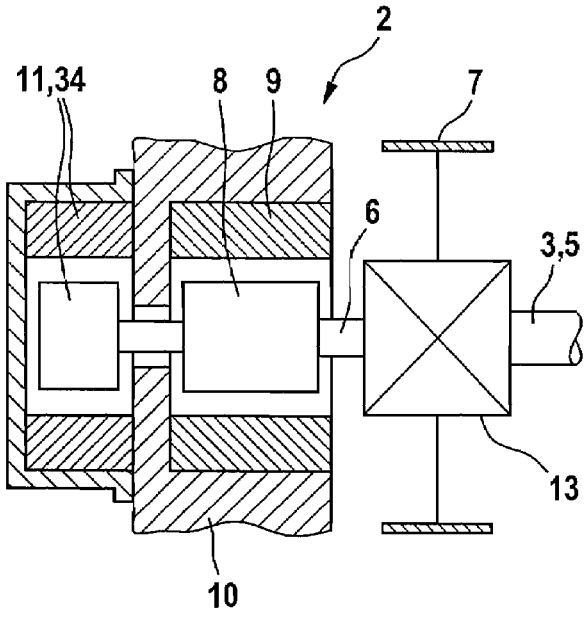

FIGS. 7*a* and 7*b* show the auxiliary drive 11 constructed as an electric motor 34, wherein its rotor is formed by the rotor of the adjustment motor 2. A separate winding as the emergency running winding 35 is constructed around the stator of the electric motor 34. The electric motor 34 is supplied with energy either by capacitors 36 or by an external network 37. Instead of the capacitors 36, a battery can also be used. Alternatively, a drive can also be realized by means of a belt or a chain. From FIG. 7*c* it becomes clear that the electric motor 34 can also be provided as an external component.

Figure 8:
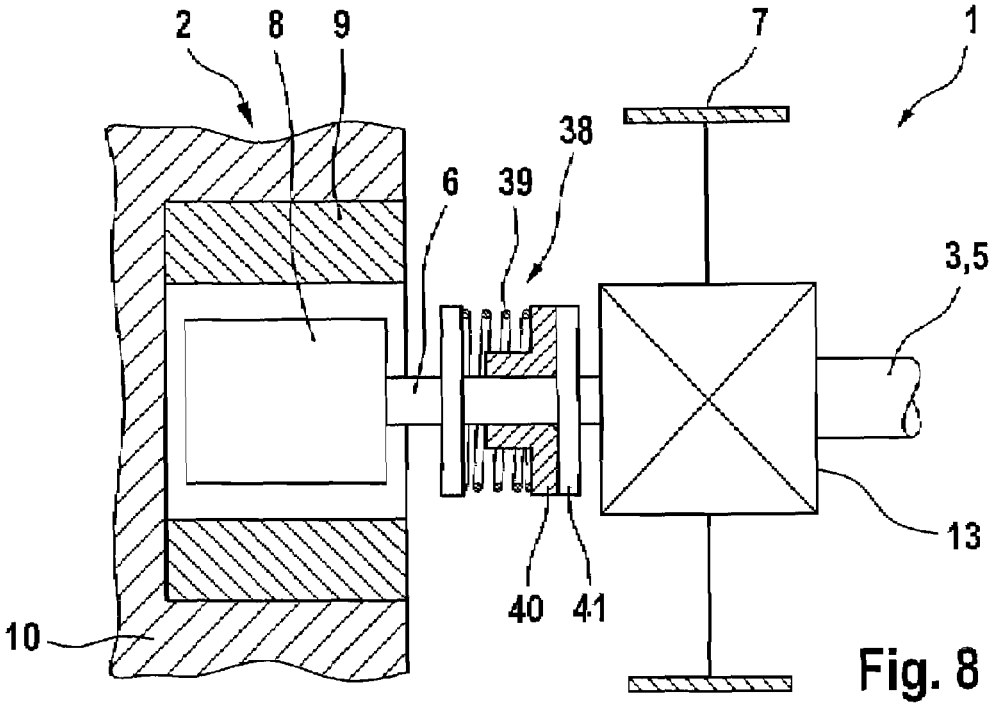

FIG. 8 shows the adjustment device 1 with an adjustment motor 2, wherein an overload coupling 38 is arranged between the adjustment motor 2 and the driven shaft 5. If the adjustment shaft 6 is blocked, then the blocking has no impeding effect on the camshaft 3. Preferably, the auxiliary drive 11 is arranged behind the overload coupling 38, so that the failed adjustment motor 2 cannot act against the auxiliary drive 11. The overload coupling 38 can be selected as a coupling known from the state of the art, for example, coupling disks 40, 41 are activated with a compression spring 39, or it can have a magnetically activated arrangement.

FIG. 9 shows an example of an arrangement of a locking unit 19, which is necessary in the previously mentioned passive systems, in order to fix the rotational angle in the case of a failure. The locking unit 19 is constructed as a radially acting spring element. The unlocking and locking is performed in this figure by means of oil pressure, which is supplied via an oil channel 42. Alternatively, the locking unit 19 can use the centrifugal force, a magnetic force, or the rotating pulse of the adjustment shaft, in order to be activated. An arrangement of the locking unit 19 in the adjustment device can be realized both axially and also radially.

In conclusion, a controlled, either active or passive restoring capacity to the base position is enabled by the configurations of an auxiliary drive 11 according to the invention when an adjustment motor 2 fails, so that the internal combustion engine can continue to operate reliably due to the fixed rotational angle between the crankshaft and the camshaft 3.

LIST OF REFERENCE SYMBOLS

1 Adjustment device
2 Adjustment motor
3 Camshaft
4 Drive part
5 Driven part
6 Adjustment shaft
7 Drive wheel
8 Rotor
9 Stator
10 Cylinder head
11 Auxiliary drive
12 Flywheel
13 Adjustment transmission
14 Torsion spring
15 Reduction gear
16 Pneumatic motor
17 Hydraulic motor
18 Spring
19 Locking unit
20 Housing
21 Pneumatic motor rotor
22 Centrifugal force motor
23 Hollow wheel
24 Connecting member
25 Planet gear
26 Web shaft
27 Sun gear
28 Carrying sleeve
29 Elongated hole
30 Mass
31 Brake
32 Brake disk
33 Brake block
34 Electric motor
35 Emergency running winding
36 Capacitors
37 External network
38 Overload coupling
39 Compression spring
40 Coupling disk
41 Coupling disk
42 Oil channel

The invention claimed is:

1. An adjustment device for adjusting a relative rotational angle position of a camshaft relative to a crankshaft of an internal combustion engine, comprising:

a crankshaft-fixed drive part and a camshaft-fixed driven part;

a primary adjustment device comprising an adjustment motor; and an auxiliary drive as a secondary adjustment device;

wherein the camshaft can be moved into a fixed rotational angle position that defines an emergency running position by the auxiliary drive upon failure of the adjustment motor;

the auxiliary drive comprises a torsion spring and a reduction gear, and is coupled to the adjustment motor to adjust the rotational angle to the emergency running position without an external supply of energy upon failure of the adjustment motor; and the torsion spring is pre-tensioned when the engine is started, decoupled in the pre-tensioned state, and is coupled with an actuator that moves the camshaft upon failure of the adjustment motor.

2. The adjustment device according to claim 1, wherein the auxiliary drive is arranged between the drive part and driven part.

3. The adjustment device according to claim 1, wherein after reaching the emergency running position, a locking unit creates a positive-fit or non-positive-fit connection between the drive part and the driven part.

4. The adjustment device according to claim 3, wherein the locking unit is constructed as an axially or radially acting pin, wedge, cone, or ball, wherein the locking unit is activated electromagnetically, hydraulically, or pneumatically.

5. The adjustment device according to claim 1, wherein the auxiliary drive is coupled permanently to the adjustment motor and adjusts the rotational angle to the emergency running position without an external supply of energy upon failure of the adjustment motor.

6. The adjustment device according to claim 1, wherein the auxiliary drive comprises a single-acting torsion spring.

7. An adjustment device for adjusting a relative rotational angle position of a camshaft relative to a crankshaft of an internal combustion engine, comprising:

a crankshaft-fixed drive part and a camshaft-fixed driven part;

a primary adjustment device comprising an adjustment motor; and an auxiliary drive as a secondary adjustment device, wherein the camshaft can be moved into a fixed rotational angle position that defines an emergency running position by the auxiliary drive upon failure of the adjustment motor; and the auxiliary drive comprises a centrifugal force motor that is permanently coupled to the adjustment motor and adjusts the rotational angle to the emergency running position without an external supply of energy upon failure of the adjustment motor.

8. An adjustment device for adjusting a relative rotational angle position of a camshaft relative to a crankshaft of an internal combustion engine, comprising:

a crankshaft-fixed drive part and a camshaft-fixed driven part;

a primary adjustment device comprising an adjustment motor; and an auxiliary drive as a secondary adjustment device;

wherein the camshaft can be moved into a fixed rotational angle position that defines an emergency running position by the auxiliary drive upon failure of the adjustment motor; and the auxiliary drive comprises a hydraulic motor or a pneumatic motor and the rotational angle is movable into the emergency running position via an external energy supply upon failure of the adjustment motor.

9. An adjustment device for adjusting a relative rotational angle position of a camshaft relative to a crankshaft of an internal combustion engine, comprising:

a crankshaft-fixed drive part and a camshaft-fixed driven part;

a primary adjustment device comprising an adjustment motor; and an auxiliary drive as a secondary adjustment device;

wherein the camshaft can be moved into a fixed rotational angle position that defines an emergency running position by the auxiliary drive upon failure of the adjustment motor; and the auxiliary drive comprises an electric auxiliary motor or an emergency running winding not permanently coupled with the adjustment motor and movable into the emergency running position via an external energy supply upon failure of the adjustment motor.

10. The adjustment device according to claim 9, wherein an energy supply of the electric auxiliary motor or the emergency running winding comprises capacitors, an external network, a battery, a chain, or a belt.

11. An adjustment device for adjusting a relative rotational angle position of a camshaft relative to a crankshaft of an internal combustion engine, comprising:

a crankshaft-fixed drive part and a camshaft-fixed driven part;

a primary adjustment device comprising an adjustment motor; and an auxiliary drive as a secondary adjustment device;

wherein the camshaft can be moved into a fixed rotational angle position that defines an emergency running position by the auxiliary drive upon failure of the adjustment motor; and an overload coupling is arranged between the adjustment motor and the driven part.

12. The adjustment device according to claim 11, wherein the auxiliary drive is not permanently coupled with the adjustment motor or the rotational angle is movable into the emergency running position via an external energy supply upon failure of the adjustment motor.

13. The adjustment device according to claim 11, wherein the overload coupling comprises a slip coupling or a shear pin.

* * * * *